US005217260A

United States Patent [19]

Boticki

[11] Patent Number: 5,217,260

[45] Date of Patent: Jun. 8, 1993

[54] CONTROL VALVE WITH UNIVERSAL PORTING FEATURE

[75] Inventor: John A. Boticki, Racine, Wis.

[73] Assignee: Fred Knapp Engraving Co., Inc., Racine, Wis.

[21] Appl. No.: 834,824

[22] Filed: Feb. 13, 1992

[51] Int. Cl.[5] ..... F15C 4/00

[52] U.S. Cl. ..... 285/12; 285/325; 285/330

[58] Field of Search ..... 285/12, 19, 290, 325, 285/330

[56] References Cited

U.S. PATENT DOCUMENTS

| | | | |
|---|---|---|---|
| 831,429 | 9/1906 | Harrington . | |
| 1,173,061 | 2/1916 | Tregloune . | |
| 1,975,494 | 10/1934 | Armacost | 285/25 |
| 2,357,755 | 9/1944 | Moll | 285/325 X |
| 3,072,148 | 1/1963 | Carls | 137/622 |
| 3,097,000 | 7/1963 | McClintock et al. | 285/142 |
| 3,130,985 | 4/1964 | Oliveau | 285/1 |
| 3,318,323 | 5/1967 | Pearson | 137/195 |
| 3,396,515 | 8/1968 | Wright | 55/269 |
| 3,538,940 | 11/1970 | Graham | 137/271 |
| 3,560,027 | 2/1971 | Graham | 285/150 |
| 3,631,878 | 1/1972 | Vander Horst | 137/116.3 |
| 3,667,493 | 6/1972 | Lindstrom et al. | 137/87 |
| 3,688,646 | 9/1972 | Flick | 92/161 |
| 3,762,224 | 10/1973 | Vander Horst | 73/420 |
| 3,793,803 | 2/1974 | Winter | 55/218 |
| 3,853,403 | 12/1974 | Bentley | 356/71 |
| 3,869,000 | 3/1975 | English | 166/315 |
| 3,879,068 | 4/1975 | Stampfli | 285/137 R |
| 3,889,484 | 6/1975 | Vander Horst et al. | 62/5 |
| 3,917,318 | 11/1975 | Legris | 285/18 |
| 3,934,605 | 1/1976 | Legris | 285/325 X |
| 3,945,465 | 3/1976 | Legris | 137/271 |
| 3,972,546 | 8/1976 | Putch | 285/18 |
| 4,011,332 | 3/1977 | Williams et al. | 333/98 R |
| 4,028,424 | 4/1978 | Obrecht | 285/137 R |
| 4,289,335 | 9/1981 | Olbermann | 285/91 |
| 4,352,511 | 10/1982 | Ribble | 285/91 |
| 4,483,365 | 11/1984 | Fallon | 137/343 |
| 4,533,020 | 8/1985 | Yamazaki | 184/55.2 |
| 4,580,817 | 4/1986 | Bonino et al. | 285/325 |
| 4,611,837 | 9/1986 | Truchet | 285/26 |
| 4,615,546 | 10/1986 | Nash et al. | 285/26 |
| 4,617,012 | 10/1986 | Vaillancourt | 285/12 X |
| 4,699,402 | 10/1987 | Stall et al. | 285/26 |
| 4,709,945 | 12/1987 | Stoll | 285/12 X |
| 4,750,411 | 6/1988 | Eversole | 98/40.05 |
| 4,958,148 | 12/1990 | Kosugi et al. | 285/133.1 |

OTHER PUBLICATIONS

Wilkerson Corporation—Product Literature—5 pages.
Watts FluidAir—Product Literature—6 pages.
SMC Pneumatics, Inc.—Product Literature 8 pages.

*Primary Examiner*—Richard E. Moore
*Attorney, Agent, or Firm*—Jansson & Shupe, Ltd.

[57] ABSTRACT

An improvement in a control valve having a body, a body interior portion and plural exterior ports in communication with the interior portion. The improvement includes a plurality of dovetail-like body slots "isolated" or spaced from other slots. Each slot intersects an aperture in fluid communication with the body interior portion. A complementarily shaped, friction-retained slide-by plate is in each slot and at least one plate includes a port in fluid communication with the slot aperture. Each plate slides for removal without disturbing any other plate. A plate may be a blind closure plate, a ported plate tapped with any of several thread sizes or a "back-to-back" interface plate for supportively mounting valve bodies in tandem. A control valve system including a slotted valve body and an assortment of plates of various types provides substantially "universal" porting between the body and another valve body and/or one or more separate control components.

22 Claims, 4 Drawing Sheets

FIG. 7
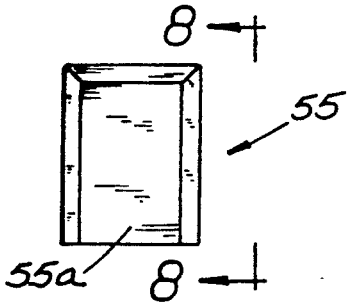
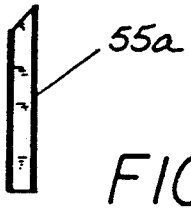
FIG. 8
FIG. 9
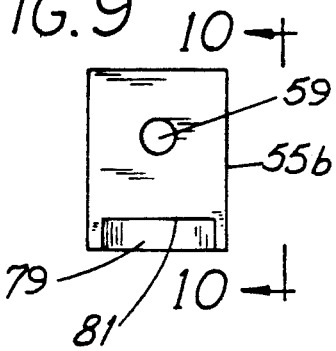
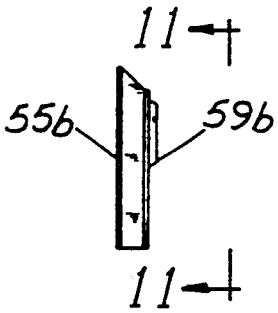
FIG. 10
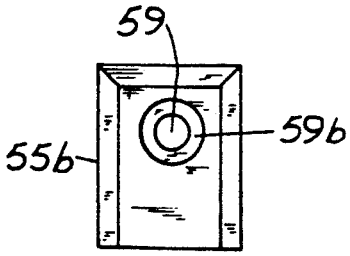
FIG. 11
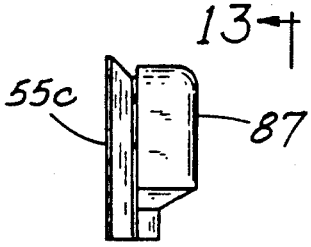
FIG. 12
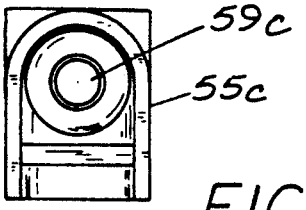
FIG. 13
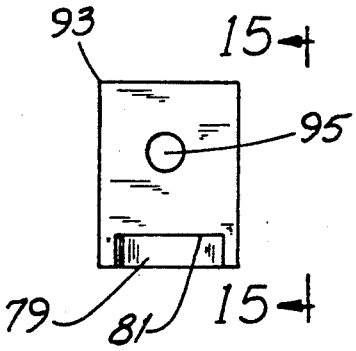
FIG. 14
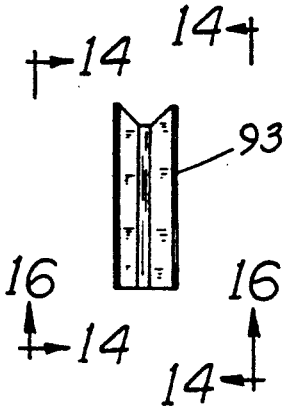
FIG. 15
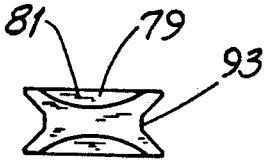
FIG. 16

CONTROL VALVE WITH UNIVERSAL PORTING FEATURE

FIELD OF THE INVENTION

This invention is related generally to valves such as those in systems using fluids (liquid and/or gas) for control and, more particularly, to fluid-compatible control valves configured to interconnect with or be mounted to other valves and/or system components.

BACKGROUND OF THE INVENTION

Industrial installations often include systems using a fluid under pressure to perform control functions. Where the fluid is a gas, it is often air and systems using pressurized gas are called "pneumatic" systems. Where the fluid is a liquid, it is often oil under pressure and such systems are referred to as "hydraulic."

Such systems are used to power assembly tools, cylinders, automatic production tools, small hoists, dental and surgical equipment, among many others. One need only walk through a modern manufacturing plant to see pneumatic and/or hydraulic control valves and systems at work.

Persons using valves and other control devices, including but not limited to pressure and vacuum regulators, frequently arrange them in a control "network." Often, construction of the network requires connection of different types of fittings to a valve body and interconnection of valve bodies to one another. And later network modifications frequently dictate reconnection of the network components.

A major problem with known valve products is lack of porting flexibility. That is, the user is required to stock a relatively large number of "dedicated" fittings, manifold blocks, connectors, clamps and the like. And if an error is made during original connection or if the network needs to be rearranged, significant disassembly is often required.

U.S. Pat. No. 2,357,755 (Moll) shows a wiring conduit fitting with a box-like body, a plate-like body closure and provisions for making a coupling at each of three sides of the body. A coupling cannot be made at the fourth side of the body where the closure is attached. The body has a dovetail slot extending in a continuum around three of its sides and each slot portion receives a cover, the side edges of which are bevelled to fit the slot. A disadvantage of the Moll arrangement is that no cover (whether blank or "ported") can be removed without removing at least the non-ported main closure.

U.S. Pat. Nos. 3,560,027 and 3,538,940 (Graham) recognizes the need for improved flexibility and porting but propose a somewhat complex solution. A distribution block has a ported, dovetail-like slot on each of four faces. The port fittings inserted axially to the port and retained in place by a U-shaped clip which engages the slots on the distributor block and a shoulder on the port fitting.

U.S. Pat. No. 3,917,318 (Legris) shows yet another approach involving a rectangular block-like body with a dovetail projection on one face and intersecting dovetail grooves on the opposite face. The patent only describes how to attach bodies to one another using the dovetail projection/slot arrangement. In other words, the described invention is a "building block" mounting system.

U.S. Pat. No. 3,869,000 (English); U.S. Pat. No. 4,011,532 (Williams et al.) and U.S. Pat. No. 1,173,061 (Tregloune) all show sliding couplers of one type or another. U.S. Pat. No. 4,289,335 (Olbermann) and U.S. Pat. No. 3,130,985 (Oliveau) show arrangements joining two components together using something of a tongue and groove arrangement with a releasable clamp.

Product literature by SMC Pneumatics mentions a porting adapter with a clamp bracket placed over the adapter for retention. Product literature by Watts FluidAir describes what it calls the QUBE system which uses modular blocks for porting. The ports are integral to the block and cannot be changed without at least a degree of system disassembly and block substitution.

The modular system shown in product literature by Wilkerson includes modular insert, connection and manifold blocks with slanted bevelled edges. They are held to one another (or to a regulator body or the like) by a clamping modular sleeve slide-fitted over the edges.

OBJECTS OF THE INVENTION

It is an object of this invention to provide overcoming some of the problems and shortcomings of valves and valve systems of the prior art.

Another object of this invention is to provide an improved control valve having a universal porting feature.

Still another object of this invention is to provide an improved control valve to which connections can be quickly and easily made and changed without disturbing other connections.

Yet another object of this invention is to provide an improved control valve whereby valve bodies can be tandem mounted to one another, with or without interconnection of the bodies for control purposes.

Another object of this invention is to provide an improved control valve system facilitating component interconnections requiring a mixture of connection types, e.g., pipe and straight thread, barbed fitting and the like.

These and other important objects will be apparent from the following detailed descriptions taken in conjunction with the drawing.

SUMMARY OF THE INVENTION

The invention is an improvement in a control valve of the type having a body, a body interior portion and plural exterior ports in communication with the interior portion. The invention provides excellent flexibility and "universal porting" between the valve body and separate, segregated control components and/or other valve bodies. The improvement comprises a plurality of body slots and, preferably, each slot intersects an aperture extending between the slot and the interior portion so that the slot and the interior portion are in fluid communication with one another. Each aperture is surrounded by a recessed O-ring seal.

A "slide-by" plate is in each slot and at least one plate includes a port in fluid communication with the slot aperture. Each slot is "isolated" from all other slots and each plate slides for removal without disturbing any other plate. Similarly, each plate can be inserted without removing or disturbing any other plate.

The body includes a central longitudinal axis and at least one plate slides along a plate axis spaced from such body axis. In a highly preferred embodiment, each plate axis is parallel to such longitudinal axis and each plate slides parallel to such axis.

After plate installation as control system connections are being made, plate are retained in the body and prevented from moving by a hex head retainer. The retainer is "seated" in a body pocket threaded to receive it in an arrangement resembling that of a countersunk bolt or screw. The retainer has an annular shoulder engaging each plate.

More specifically, each plate has a "carved out" or curved retainer relief area and a contact surface engaged by the retainer shoulder. In that way, the plate extends to a body end surface while yet permitting plate retention. The body end surface has holes in it for fasteners. Such surface is available for attachment of a component such as a manifold mount. Since the outward extremity of the retainer is at least flush with this end surface, the arrangement permits such component attachment notwithstanding the retainer.

Preferably, each slot is dovetail-like or undercut into the body, is generally rectangular in perimeter shape, has an inner terminus and extends between such terminus and the end surface. Each plate is complementarily-formed with an angled, outwardly-extending lip for frictional plate retention in the slot.

The valve body may be cylindrical, elliptical or of some other cross-sectional geometric shape. However, in a highly preferred arrangement, the body is generally square or rectangular in cross-sectional shape (and therefore has four sides) and rounded edges. A slot is formed in at least two sides and, preferably, in all four sides of the body, thereby permitting four body-and-component connections.

A feature of the improved valve is that two or more valve bodies can be "interfaced" or tandem mounted to one another without using plumbed tube-and-fitting connections. To that end, at least one slide-by plate is an interface plate. In construction, the interface plate closely resembles two slide-by plates oriented back-to-back and formed as a unitary (one-piece) plate. Each "half" of the interface plate slides into a slot on a separate valve body. Each valve body includes at least one body slot intersecting an aperture in fluid communication with a body interior portion. Since one type of interface plate includes a passage interconnecting apertures and body interior portions, the body interior portions are in fluid communication with one another. On the other hand, when the interface plate is imperforate, bodies are tandem mounted while yet avoiding interconnection between them. That is, the body interior portions are thereby isolated from one another. And more than two valve bodies can be mounted in "strings" with or without interconnection.

Users of control valves frequently need to connect such valves to "segregated" control components, i.e., components located some distance from the valve. And such components often have threaded ports and/or barbed, tube-type connectors. The improved valve meets these needs, as well.

The improved valve comprises part of an improved control valve system which includes a first valve body, a body interior portion and at least one segregated or remotely mounted control component. For connection flexibility, the system has a plurality of plates including at least one plate having a 1-8 NPT port, at least one plate having a 10-32 UNF port and at least one imperforate (or "blind") plate. Such a system, which may be put up in kit or kit-like form, provides substantially universal porting between the valve body and the control component and/or a second valve body.

A detailed description of the invention is set out below. After analyzing such description, readers will appreciate yet other features of the invention and how it solves formerly-difficult control device and system interconnection problems.

BRIEF DESCRIPTION OF THE DRAWINGS

FIG. 7 is a front elevation view of a "blind" (imperforate) slide-by plate.

FIG. 8 is an edge elevation view of the plate of FIG. 7 taken along the viewing plane 8—8 of FIG. 7.

FIG. 9 is a rear elevation view of a plate like that of FIGS. 7 and 8 except with a fluid flow passage therethrough.

FIG. 10 is an edge elevation view of the plate of FIG. 9 taken along the viewing plane 10—10 thereof.

FIG. 11 is a front elevation view of the plate of FIGS. 9 and 10 taken along the viewing plane 11—11 of FIG. 10.

FIG. 12 is an edge elevation view of a slide-by plate having a raised boss for attaching a fitting.

FIG. 13 is a rear elevation view of the plate of FIG. 12 taken along the viewing plane 13—13 of FIG. 12.

FIG. 14 is a rear elevation view of an interface plate taken along either viewing plane 14—14 of FIG. 15.

FIG. 15 is an edge elevation view of the interface plate of FIG. 14 taken along the viewing plane 15—15 of FIG. 14.

FIG. 16 is an end elevation view of the interface plate of FIGS. 14 and 15 taken along the viewing plane 16—16 of FIG. 15.

DETAILED DESCRIPTIONS OF THE PREFERRED EMBODIMENTS

Figure 1:
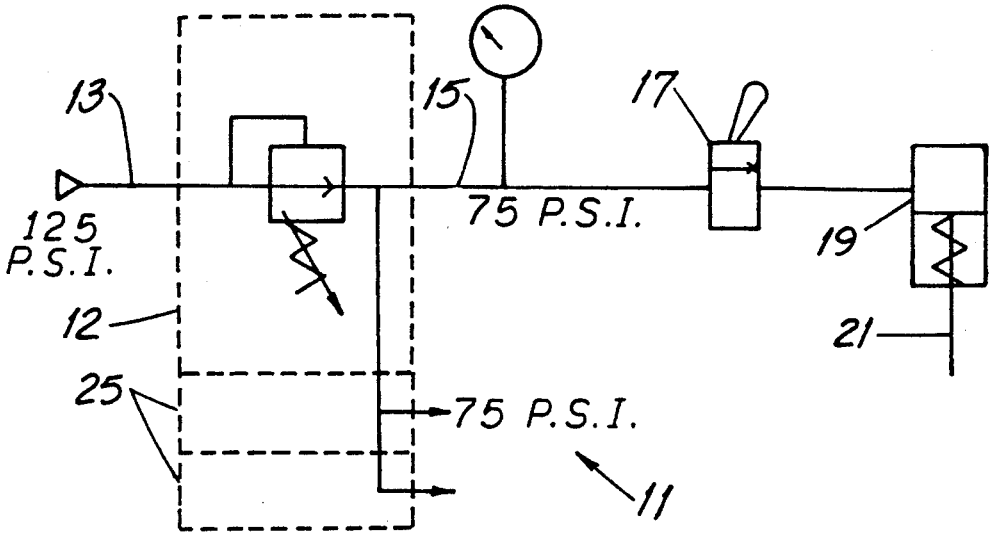
FIG. 1 is an exemplary circuit diagram of a simple pneumatic control system of the type in which the invention is used.

Before describing the invention, it will be helpful to have a basic understanding of a simple system 11 of a type in which the invention is used. Referring to FIG. 1, a pressure regulator valve 12 includes an inlet 13 of pressurized air and an output line 15 regulated at a substantially constant pressure, e.g., 75 p.s.i. So long as the pressure at the inlet 13 is between 75 p.s.i. and some nominal maximum in excess thereof, the pressure in the output line 15 remains constant.

The handle of a remotely-mounted, manually-operated valve 17 is moved in one direction to direct pressurized air into the cylinder 19, causing its rod 21 to extend. When the handle is moved to the "off" position, the rod retracts under the urging of the compression spring 23.

The dashed boxes 25 represent additional regulator valves and/or other types of control valves connected to the regulator valve 12. Merely by way of example, the invention is used to make such "inter-valve" connections and/or to connect the inlet 13 and output line 15 to the valve 12.

Figure 2:
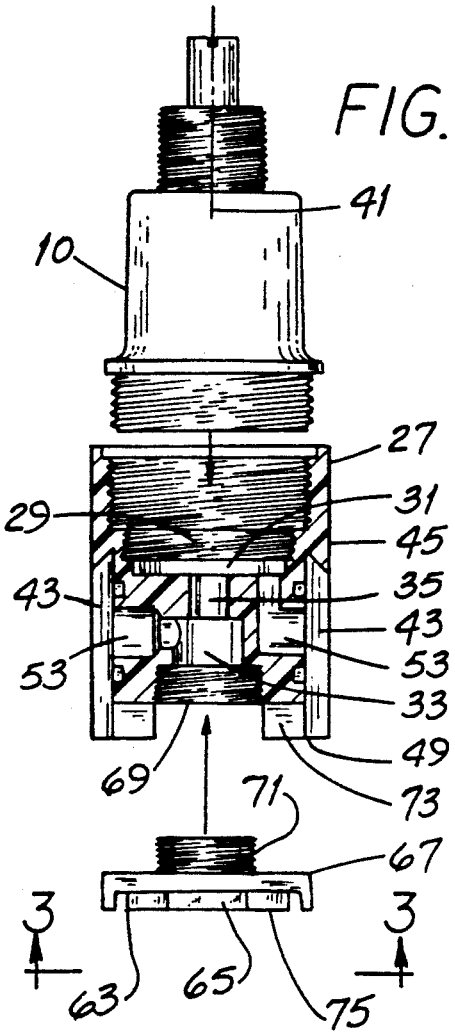
FIG. 2 is a side elevation view, partly in section, showing a valve body.
Figure 4:
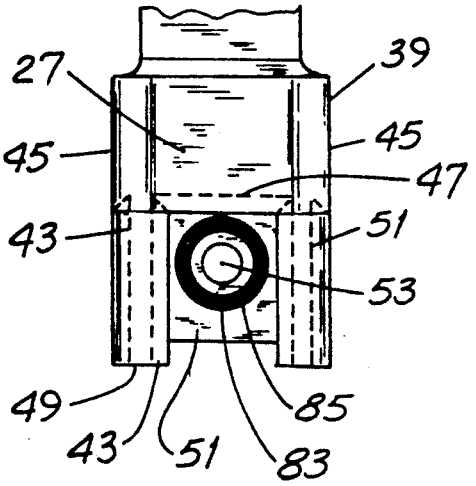
FIG. 4 is a side elevation view of a valve body like that of FIG. 2, with parts broken away and other parts in dashed outline.
Figure 3:
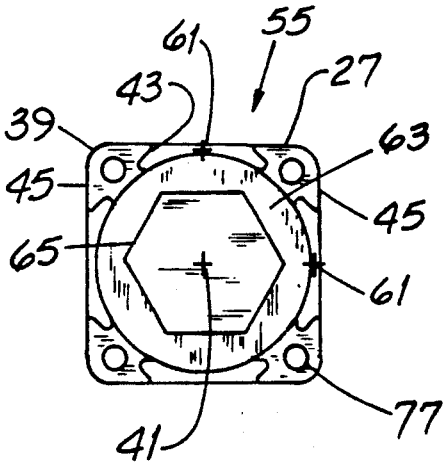
FIG. 3 is a full representation bottom plan view of the body of FIG. 2 taken along the viewing plane 3—3 of FIG. 2.

Referring next to FIGS. 2–4, the improved control valve 10 has a body 27 and a body interior portion 29 through which fluid, e.g., compressed air flows as the system 11 performs it function. The illustrated body 27 is that of a regulator constructed to maintain a pre-set pneumatic pressure.

The interior portion 29 of the illustrated valve includes a pair of cavities 31, 33 separated by an orifice 35. As air flows through the cavities 31, 33, a pressure drop or "differential" is created across the orifice 35. That is, the pressures in the two cavities 31, 33 differ from one another during air flow. It is the value of this pressure differential which is used for control. Regulators using pressure differential orifices for control are known. The invention is shown in connection with a regulator valve 10 as an example of but one kind of apparatus which benefits from the invention.

The valve body 27 preferably has a generally square cross-sectional shape with rounded corners 39 and a central longitudinal axis or center line 41. In a highly preferred arrangement, an undercut or dovetail-like slot 43 is formed in each of the four body sides 45. Each slot 43 has a generally rectangular perimeter and an inner terminus 47 and extends between such terminus 47 and the end surface 49 of the body 27. Each slot floor 51 includes an intersecting aperture 53 extending between the slot 43 and a cavity 31, 33. It should be noted that in the case of a pressure regulator valve 10, an aperture 53 extends between a slot 43 and the cavity 31 while another aperture 53 extends between a slot 43 and the cavity 33. Apertures 53 are thereby in fluid communication with the interior portion 29 of the body 27. In that way, the pressure in a cavity 31, 33 can be sensed from an exterior connection in a manner that will become apparent.

Figure 5:
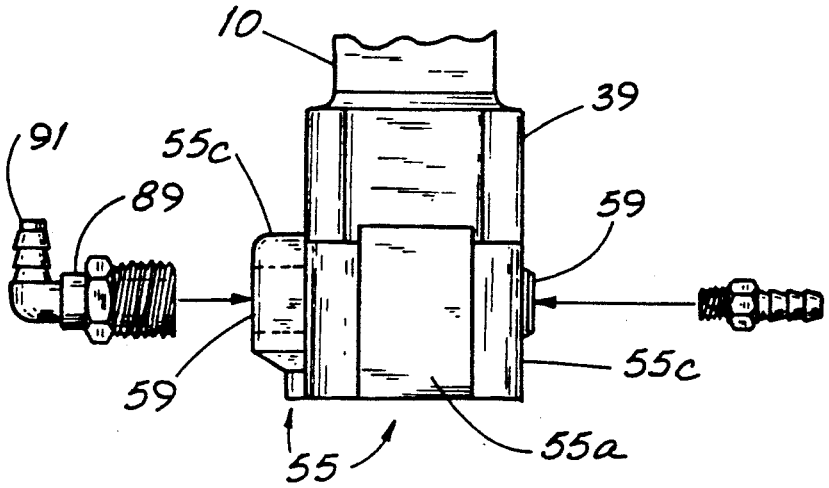
FIG. 5 is a side elevation view of a valve body like that of FIGS. 2 and 4, with slide plates in place, showing how fittings are attached thereto.
Figure 6:
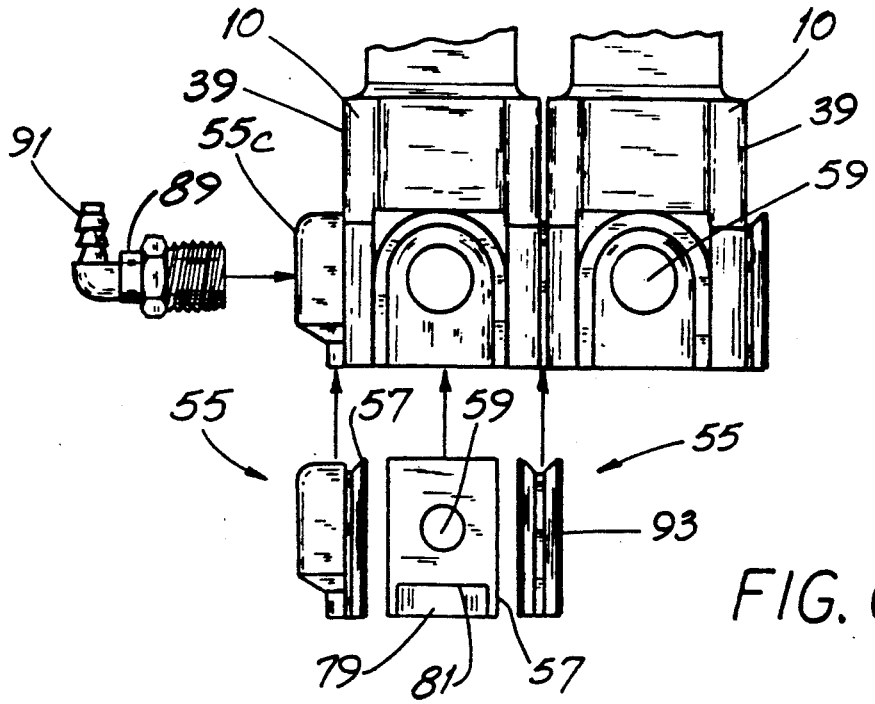
FIG. 6 is a side elevation view, with parts broken away, showing how two valve bodies are connected together with an interface plate and further showing how slide-by plates are fitted to a body.

Referring additionally to FIGS. 5 and 6, a slide-by plate 55 is in each slot 43. Each plate 55 is complementarily-formed with an outwardly-angled extending edge or lip 57 for frictional plate retention in the slot 43. After understanding the invention, those of ordinary skill will appreciate how the valve 10 may be constructed using other slot and lip configurations. Particularly, in preferred configurations, the slot 43 and plate lip 57 are generally conformably shaped and sized for frictional plate retention while yet permitting the plate 55 to be inserted and removed without undue force.

At least one plate 55 includes a port 59 in fluid communication with the slot aperture 53 when the plate 55 is "seated" in the slot 43. As described in greater detail below, plates 55 include a variety of threaded ports 59 or such plates 55 (like plate 55*a*) are "blind," i.e., devoid of a plate port 59.

From the foregoing description and an inspection of FIGURES, it will be appreciated that each slot 43 is isolated from all other slots 43. In other words, the slots 43 do not "run together" but are independent from one another so that each plate 55 slides for insertion or removal without disturbing any other plate 55. As shown in FIG. 3, at least one plate 55 slides along a plate axis 61 spaced from and parallel to the body axis 41.

While plates 55 and slots 43 are sized and shaped for good frictional plate retention (consistent with occasional plate insertion and removal), the valve 10 also includes a retainer 63 preventing plate movement. Referring to FIGS. 2 and 3, a preferred retainer 63 has a hexagon head 65 (or other head or pocket shaped for torque-transmitting) and an annular shoulder 67. The retainer 63 attaches to a body socket 69 by a threaded nose 71 and, when seated, is received within a retainer pocket 73.

Preferably, the pocket 73 and retainer 63 are cooperatively formed so that when the retainer 63 is fully seated, its outer surface 75 is at least flush with or slightly below the end surface 49 of the valve body 27. The end surface 49 is generally flat, has a screw hole 77 at each corner 39 and is accessible for component attachment. After the plates 55 are in place and the retainer 63 seated, a component such as a manifold block (not shown) may be attached to the end surface 49.

As shown in FIGS. 6, 9, 13 and 14, each plate 55 has a "carved out" curved retainer relief area 79 and a contact surface 81 engaged by the retainer shoulder 67. Such area 79 and shoulder 67 permit the retainer 63 to hold the plates 55 in place while seated in the body 27 so that its outer surface 75 does not extend beyond the body end surface 49. In that way, the plate 55 extends past the shoulder 67 to the end surface 49 and still be solidly retained in the body 27. Each aperture 53 has a concentric O-ring 3 in an annular groove 85 and extending the plate 55 in the described manner provides a generous plate/O-ring sealing area and helps prevent leakage.

As depicted in FIGS. 7–16, plates 55 are preferably in an assortment with a variety of connection configurations. For example, the plate 55*b* of FIGS. 9–11 has a 10–32 UNF internal thread port 59*b*. The plate 55*c* shown in FIGS. 12 and 13 includes a raised boss 87 with a $\frac{1}{8}$ inch or $\frac{1}{4}$ inch NPT internal thread port 59*c*. A similar plate 55*c* accommodates a right angle straight thread fitting 89 with barbed connector 91 as shown in FIGS. 5 and 6. The aforementioned plates 55 are merely a few examples of the many different connection possibilities for which plates 55 are configured.

Even though the aforementioned valve body 27 provides substantially universal porting between the body 27 and a remote control component like valve 17, that is not the only connection capability provided by the invention. Referring to FIGS. 6, 14, 15 and 16, the system 11 also includes an interface plate 93 for tandem mounting two valve bodies 27. The interface plate 93 closely resembles two slide-by plates 55 arranged back to back and molded in one piece. Each half of the interface plate 93 slides into a slot 43 on a separate valve body 27. When the interface plate 93 includes a passage 95 and each lip 57 of the plate 93 engages a body slot 43 intersecting an aperture 53, the plate passage 95 interconnects apertures 53 and body interior portions 29 so that such portions 29 are in fluid communication with one another. With an imperforate interface plate 93, bodies 27 are tandem or gang mounted while yet avoiding interconnection between them.

Figure 17:
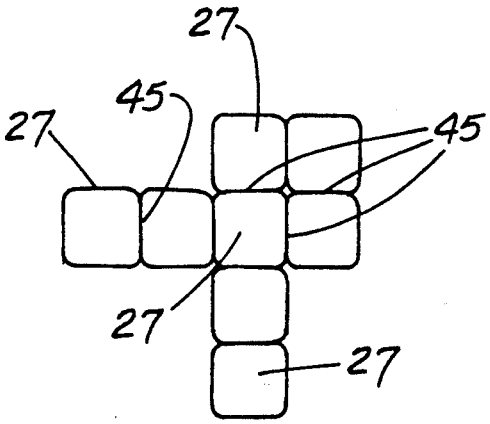
FIG. 17 is a representative top plan view showing an example of how valve bodies can be connected together using aspects of the invention.

From the foregoing, it should be appreciated that valve bodies 27 can be mounted in "strings" of two, three or more and from any one, some or all sides 45 of a body 27 as shown in the example of FIG. 17. Each pair of bodies 27 is connected by an interface plate 93 of one of the types described above and shown in FIGS. 14–16. Such connection is at least for mechanical support/mounting. Where an interface plate 93 having a passage 95 is used, fluid connection is also provided.

From the foregoing, it is apparent that valve bodies 27, plates 55, 93 and the like comprise an improved control valve system 11. Such system 11, which may be packaged in kit form, for example, includes one or more valve bodies 27, and an assortment of plates 55, 93. Each of a plurality of slide-by plates 55, 93 is complementarily-formed for frictional retention in a slot 43. The system 11 preferably includes at least one imperforate plate 55*a* as well as at least one plate 55*b*, 55*c* having 1–8 NPT and 10–32 UNF ports, respectively. And, of course, plates 55 with other types of NPT or UNF ports may be included. Such a system 11 has a enormous flexibility and provides substantially universal porting between one or more valve bodies 27 and other control components, e.g., valve 17 and cylinder 19.

While the principles of this invention have been described in connection with specific embodiments, it should be understood clearly that these descriptions are made only by way of example and are not intended to limit the scope of the invention.

I claim:

1. In a control valve having a body, a body interior portion and plural exterior ports in communication with the interior portion, the improvement comprising:

a plurality of body slots, each slot being defined by a pair of grooves and each slot intersecting an aperture in fluid communication with the interior portion;

a slide-by plate in each slot, the plates being closely adjacent to one another and at least one plate including a port in fluid communication with the slot aperture;

each slot being isolated from all other slots, whereby each plate slides for removal without disturbing any other plate.

2. The valve of claim 1 wherein the body includes a central longitudinal axis, at least the plate in the discontinuous slot has a plate axis generally parallel to the central longitudinal axis and slides in a direction along the plate axis.

3. The valve of claim 1 wherein each of the slide-by plates has an end and the valve includes a retainer bearing against the ends and preventing plate movement.

4. The valve of claim 3 wherein the body includes:

a pocket receiving the retainer; and, an end surface accessible for component attachment notwithstanding such retainer.

5. The valve of claim 4 wherein each plate has a retainer relief area whereby the plate may extend to the end surface while yet permitting plate retention.

6. The valve of claim 1 wherein each slot is dovetail-like and discontinuous from all other slots and each plate is complementarily-formed for frictional retention in the slot.

7. The valve of claim 6 wherein the body includes an end surface and each slot is generally rectangular, has an inner terminus and extends between such terminus and the end surface.

8. The valve of claim 6 wherein the body has four sides and a slot is formed in at least two sides.

9. The valve of claim 8 wherein a slot is formed in all four sides thereby permitting four component connections to such body.

10. The valve of claim 1 wherein at least one slide-by plate is an interface plate for tandem mounting two valve bodies.

11. The valve of claim 10 wherein the valve bodies each include at least one body slot intersecting an aperture in fluid communication with a body interior portion and the interface plate includes a passage interconnecting apertures and body interior portions whereby such interior portions are in fluid communication with one another.

12. The valve of claim 10 wherein the interface plate is imperforate whereby bodies are tandem mounted while yet avoiding interconnection therebetween.

13. An improved control valve system including a first valve body, a body interior portion, at least one segregated control component, and further comprising:

a plurality of body slots in the first valve body, each slot being defined by a pair of grooves, each slot intersecting an aperture in fluid communication with the interior portion and each slot being isolated from all other slots;

a plurality of slide-by plates, closely adjacent to one another each plate being complementarily-formed for frictional retention in a slot, the plurality of plates including:

(a) at least one plate having a 1–8 NPT port;

(b) at least one plate having a 10–32 UNF port;

(c) at least one imperforate plate;

and wherein each plate is spaced from all other plates and slides for removal without disturbing any other plate.

14. The system of claim 13 further including a second valve body having a body slot and the plurality of plates includes an interface plate for tandem mounting the valve bodies.

15. The system of claim 14 wherein the body slot of the second valve intersects an aperture in fluid communication with an interior portion of the second valve and the interface plate includes a passage interconnecting the interior portions of the bodies whereby the valve bodies are in fluid communication with one another.

16. The valve of claim 14 wherein the interface plate is imperforate whereby the bodies are tandem mounted while yet avoiding interconnection therebetween.

17. In a control valve having a body, a body interior portion and plural exterior ports in communication with the interior portion, the improvement comprising:

a plurality of body slots, each slot intersecting an aperture in fluid communication with the interior portion and each slot being isolated from all other slots whereby each plate slides for removal without disturbing any other plate;

a slide-by plate in each slot, at least one plate including a port in fluid communication with the slot aperture and at least one plate being an interface plate tandem mounting a second valve body.

18. The valve of claim 17 wherein each of the valve bodies includes at least one body slot intersecting an aperture in fluid communication with a body interior portion and the interface plate includes a passage interconnecting apertures and body interior portions of both bodies whereby the interior portion of the bodies are in full communication with one another.

19. The valve of claim 17 wherein the interface plate is imperforate whereby the valve bodies are tandem mounted while yet avoiding fluid interconnection therebetween.

20. An improved control valve system including a first valve body, a body interior portion, at least one segregated control component, and further comprising:

a plurality of body slots in the first valve body, each slot intersecting an aperture in fluid communication with the interior portion and each slot being isolated from all other slots;

a plurality of slide-by plates, each complementarily-formed for frictional retention in a slot, the plurality of plates including at least one plate having a 1-8 NPT port, at least one plate having a 10-32 UNF port, and at least one imperforate plate;

and the system further includes:

a second valve body having a body slot; and, an interface plate engages a slot in the first body and a slot in the second body, thereby tandem mounting the bodies.

21. The system of claim 20 wherein:

the second body has an interior portion;

the slot of the second body intersects an aperture in fluid communication with the interior portion of the second body; and, the interface plate includes a passage interconnecting the interior portions of the bodies so that the bodies are in fluid communication with one another.

22. The system of claim 20 wherein the interface plate is imperforate whereby the bodies are tandem mounted while yet avoiding interconnection therebetween.

* * * * *